US010211574B2

(12) United States Patent
Zhao

(10) Patent No.: US 10,211,574 B2
(45) Date of Patent: Feb. 19, 2019

(54) ELECTRICAL CONNECTOR AND METHOD OF MAKING THE SAME

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/826,610

(22) Filed: Nov. 29, 2017

(65) Prior Publication Data

US 2018/0151987 A1 May 31, 2018

(30) Foreign Application Priority Data

Nov. 29, 2016 (CN) ..... 2016 1 1070076

(51) Int. Cl.

| | |
|---|---|
| ***H01R 13/6585*** | (2011.01) |
| ***H01R 13/506*** | (2006.01) |
| *H01R 13/405* | (2006.01) |
| *H01R 13/6471* | (2011.01) |
| *H01R 24/60* | (2011.01) |

(52) U.S. Cl.

CPC ..... *H01R 13/6585* (2013.01); *H01R 13/506* (2013.01); *H01R 13/405* (2013.01); *H01R 13/6471* (2013.01); *H01R 24/60* (2013.01)

(58) Field of Classification Search

CPC ..... H01R 13/6585; H01R 13/506; H01R 13/405; H01R 13/6471

USPC ..... 439/607.05

See application file for complete search history.

(56) References Cited

U.S. PATENT DOCUMENTS

| | | | | |
|---|---|---|---|---|
| 7,758,379 | B2 * | 7/2010 | Chen | H01R 13/6485 439/607.11 |
| 9,231,356 | B1 * | 1/2016 | Ju | H01R 24/78 |
| 9,306,336 | B2 * | 4/2016 | Chang | H01R 13/6471 |
| 2013/0330976 | A1 * | 12/2013 | Simmel | H01R 13/659 439/660 |
| 2015/0044886 | A1 * | 2/2015 | Little | H01R 12/75 439/55 |

(Continued)

FOREIGN PATENT DOCUMENTS

| | | |
|---|---|---|
| CN | 204947243 U | 4/2015 |
| CN | 107204527 A | 3/2016 |

*Primary Examiner* — Alexander Gilman

(74) *Attorney, Agent, or Firm* — Wei Te Chung; Ming Chieh Chang

(57) ABSTRACT

An electrical connector includes: an insulative housing having a base portion and a mating tongue extending forwardly from the base portion, the mating tongue defining two opposite mating faces and a step portion at a root thereof to the base portion; two rows of terminals retained in the insulative housing and including contacting portions disposed on the mating surface and in front of the step portion; a pair of discrete metal plates located between the two rows of terminals, each metal plate comprising a first plate portion disposed in the mating tongue, a second plate portion disposed in the base portion, each first plate portion defining a locking edge at outer side thereof and exposed to corresponding side face of the mating tongue; and each metal plate defines an extending portion bent upwardly, the extending portion covers the matting surface of the step portion.

19 Claims, 10 Drawing Sheets

(56) References Cited

U.S. PATENT DOCUMENTS

| | | | | |
|---|---|---|---|---|
| 2015/0126069 | A1* | 5/2015 | Little | H01R 24/60 439/607.55 |
| 2015/0295362 | A1* | 10/2015 | Tziviskos | H01R 13/6581 439/607.01 |
| 2016/0056586 | A1* | 2/2016 | Guo | H01R 13/41 439/607.05 |
| 2016/0064866 | A1* | 3/2016 | Kao | H01R 13/6461 439/676 |
| 2016/0064869 | A1* | 3/2016 | Yu | H01R 24/60 439/607.05 |
| 2017/0201048 | A1* | 7/2017 | Kong | H01R 13/6594 |

* cited by examiner

ELECTRICAL CONNECTOR AND METHOD OF MAKING THE SAME

BACKGROUND OF THE INVENTION

1. Field of the Invention

The present invention relates to an electrical connector having a pair of metal plates.

2. Description of Related Art

China Utility Patent Issued No. 204947243, issued on Jan. 6, 2016, discloses a socket connector including an insulative housing, two rows of terminals, a shielding plate disposed on the insulative housing and a metal shell surrounding the insulative housing to form a mating cavity. The shielding plate comprises a pair of grounding plates respectively bent from two lateral sides of the shielding plate, the one grounding plate is shielded to the upper surface of the insulative housing and another one is shielded to the lower surface of the insulative housing, the two grounding plates are arranged in parallel along an up-to-down direction. However, this structure is not available to material saving, and tends to increase the thickness of the electrical connector, which is not conducive to miniaturization.

An improved electrical connector is desired.

SUMMARY OF THE INVENTION

One object of the present invention is to provide an electrical connector comprising: an insulative housing having a base portion and a mating tongue extending forwardly from the base portion, the mating tongue defining two opposite mating faces and a step portion at a root thereof to the base portion; two rows of terminals retained in the insulative housing and including contacting portions disposed on the mating surface and in front of the step portion; a pair of discrete metal plates located between the two rows of terminals, each metal plate comprising a first plate portion disposed in the mating tongue, a second plate portion disposed in the base portion, each first plate portion defining a locking edge at outer side thereof and exposed to corresponding side face of the mating tongue; and each metal plate defines an extending portion bent upwardly, the extending portion covers the matting surface of the step portion.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

FIGS. 1 to 10 show an electrical connector 100 adapted for being mounted upon a printed circuit board (not shown) and cooperated with a mating connector (not shown). For convenience, the electronic connector 100 defines a mating port, an insertion direction, a transverse direction perpendicular to the insertion direction and forming a horizontal plane therebetween, and a vertical direction perpendicular to the insertion direction and the transverse direction in FIG. 1.

Figure 1:
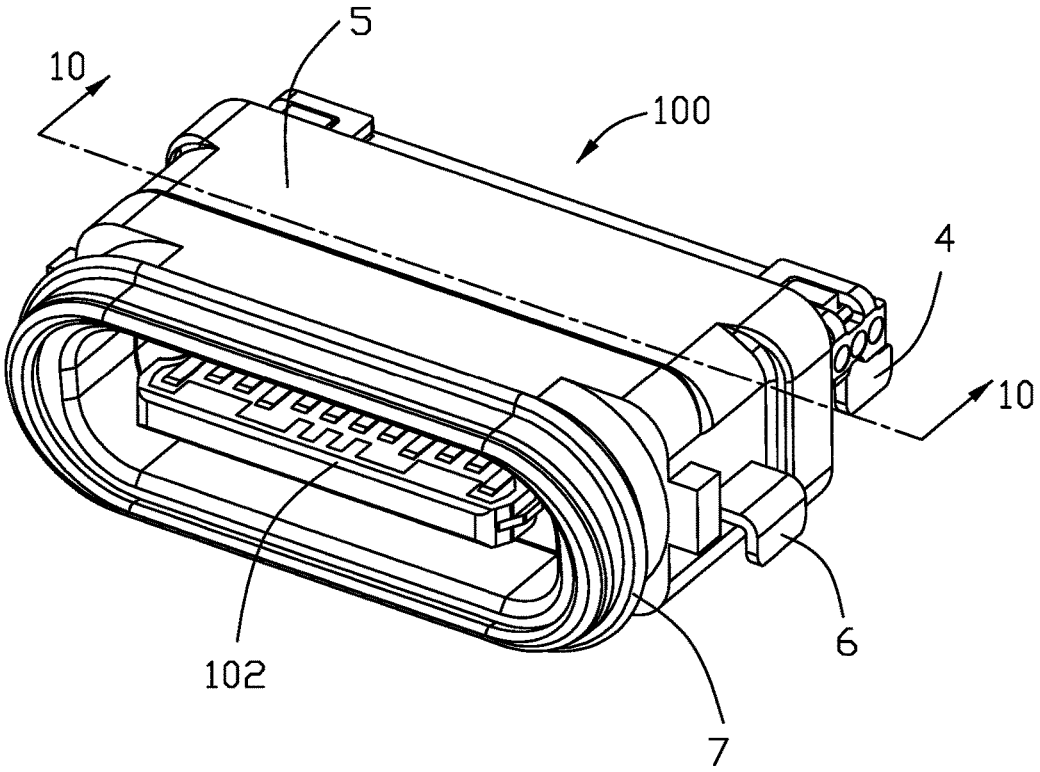
FIG. 1 is a top and front perspective view of the electrical connector.
Figure 2:
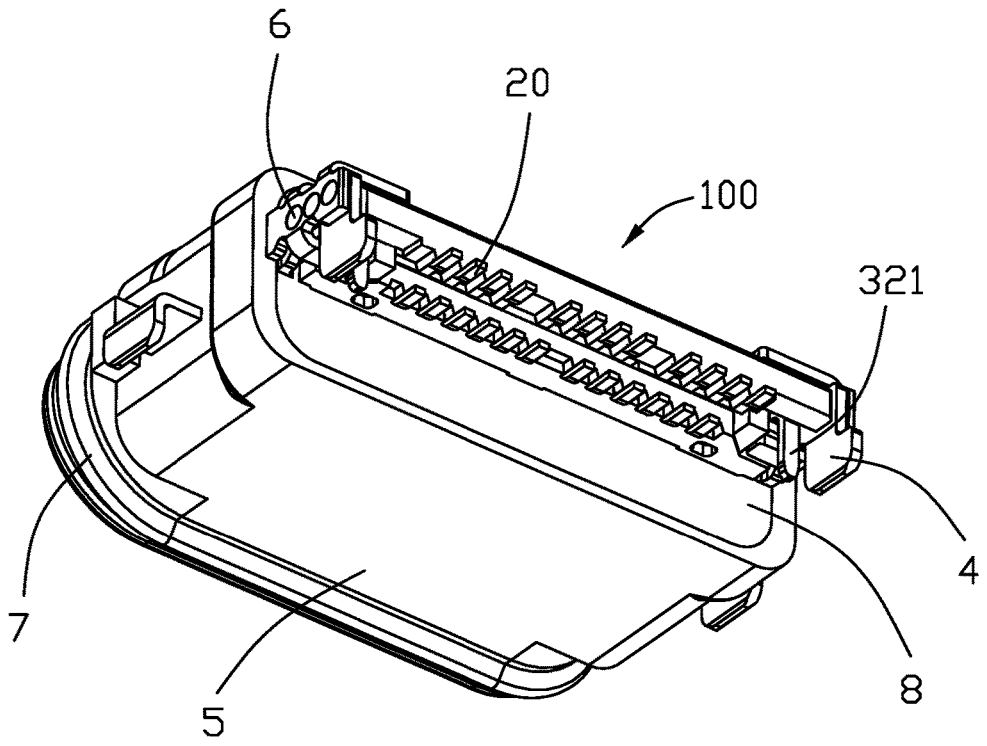
FIG. 2 is a rear and bottom perspective view of the electrical connector.
Figure 3:
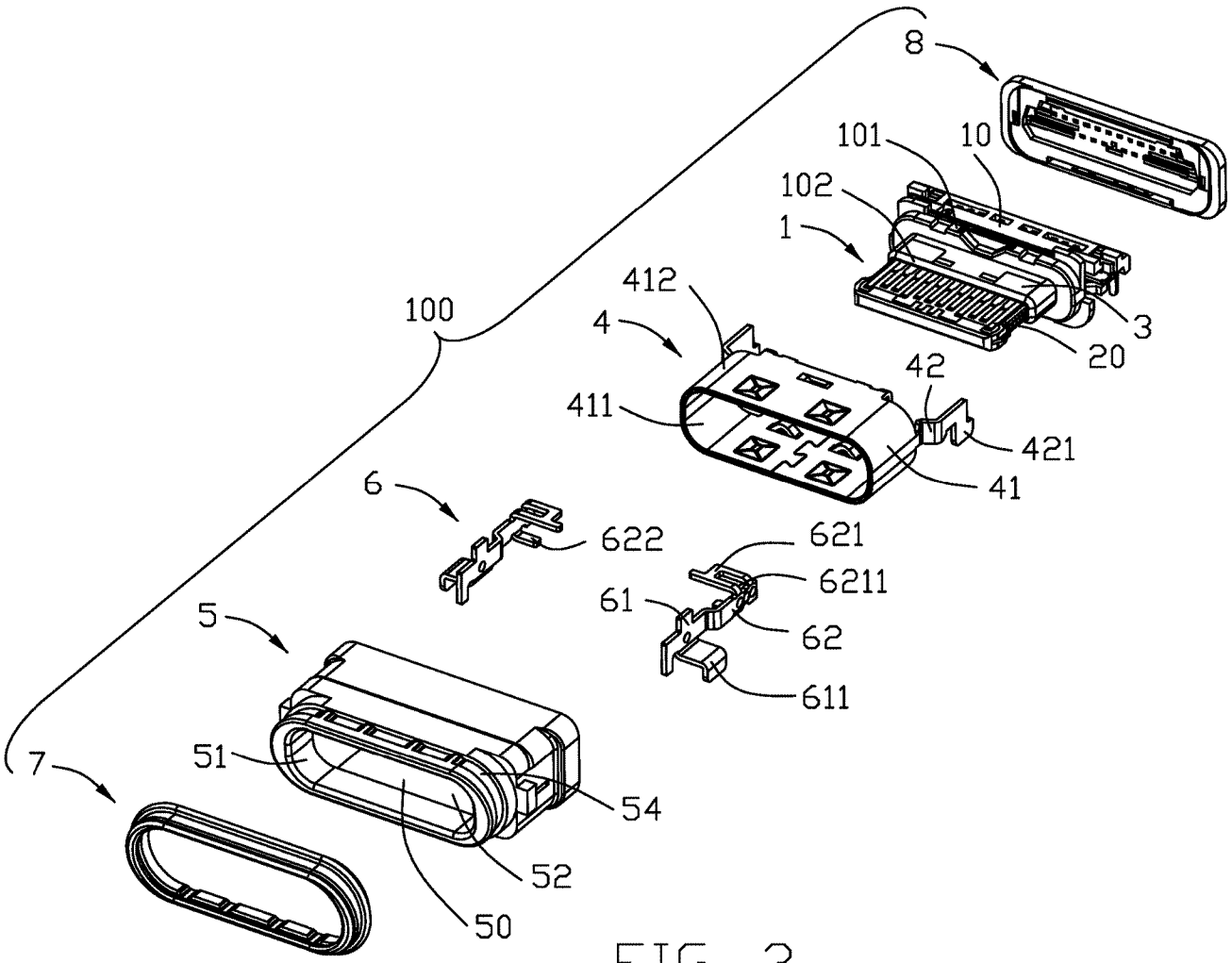
FIG. 3 is an exploded perspective view of the electrical connector of FIG. 1.
Figure 4:
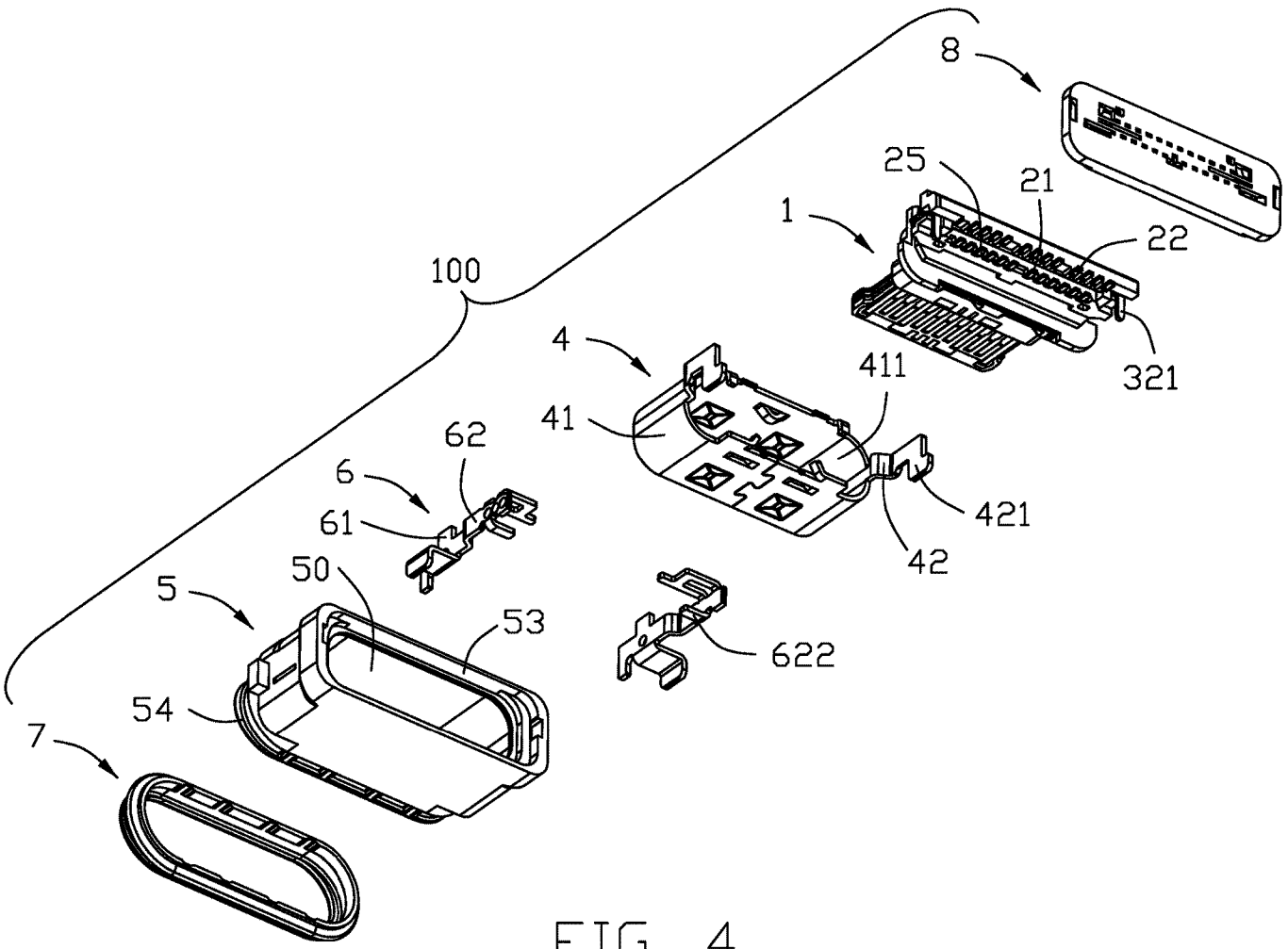
FIG. 4 is an exploded perspective view of the exploded electrical connector of FIG. 3.
Figure 5:
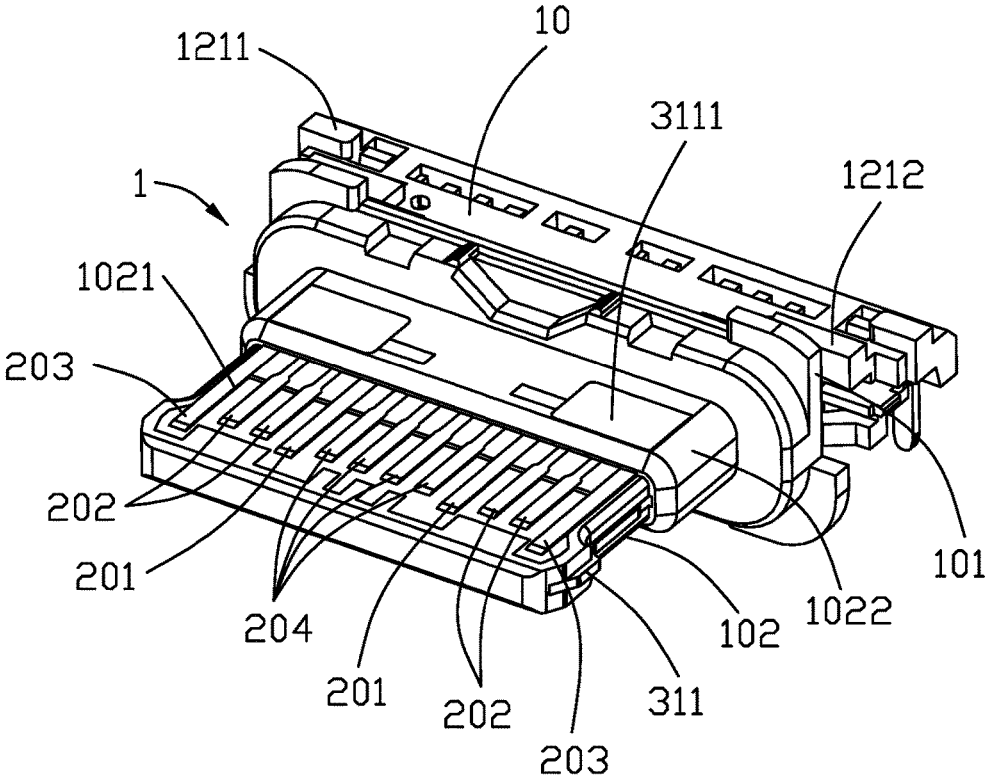
FIG. 5 is a perspective view of the terminal module of FIG. 3.

Referring to FIGS. 3-5 the electrical connector 100 includes a terminal module 1, a shielding shell 4 surrounding the outside of the terminal module 1, an insulative shell 5 integrally formed with the shielding shell 4, a pair of supporting members 6 retained in the insulative shell 5 and a waterproof ring 7 and a waterproof glue plate 8 respectively retained in the front end and the rear end of the insulative shell 5.

Referring to FIGS. 5 to 9 combination with FIG. 3, the terminal module 1 includes an insulative housing 10, two rows of terminals 20 and a pair of metal plates 3 retained in the insulative housing 10. The insulative housing 10 defines a base portion 101 and a mating tongue 102 extending forwardly from the base portion 101. The mating tongue 102 defines two opposite mating faces 1021 and further formed with a thickened step portion 1022 at a root thereof to the base portion 101, the mating tongue 102 further includes retaining slots 1023 on two sides thereof. The insulative housing 10 includes a first insulator 11, a second insulator 12 and a third insulator 13 made through three insert-molded processes. The first insulator 11 includes a first base 111 and a first tongue 112 extending forwardly from the first base 111. The second insulator 12 includes a second base 121 and a second tongue 122 extending forwardly from the second base 121. The third insulator 13 includes a third base 131 and a third tongue 132 extending forwardly from the third base 131. The third base 131 is surrounding around and filled between the first base 111 and the second base 121 constructs the base portion 101, the third tongue 132 is surrounding around and filled with the first tongue 112 and the second tongue 122 constructs the mating tongue 102.

Two sides of the rear end of the first base 111 include two mounting portions 1111, and the first tongue 112 defines a pair of first posts 1121 on a same plane and a pair of first retaining grooves 1122 symmetrical with said two first posts 1121. The second base 121 includes two tabs 1211 and two blocking walls 1212. The second tongue 122 defines a pair of second posts 1221 on a same plane and a pair of second retaining grooves 1222 symmetrical with said two second posts 1221. The first and second posts 1121, 1221 are aligned with each other. The tabs 1211 are formed from the upper surface of two sides of the rear portion of the second base 121 and extending upwardly. The blocking walls 1212 are located in front of the tabs 1211 along the insertion direction. Due to the different lengths of the terminals 20 retained in the second insulator 12, the front surfaces of the second tongue 122 are not in a same plane. The third base 131 includes a plurality of resisting grooves 1311 and four blocking portions 1312 disposed at the two sides of the rear upper and lower surfaces of the base portion 101, the resisting grooves 1311 are evenly disposed in front of the third base 131. The four blocking portions 1312 are divided into two pairs of upper and lower portions, and each pair blocking portion 1312 is respectively symmetrically disposed at the two lateral ends of the third base 131. Each blocking portion 1312 is an arc-shaped plate structure, and there is a gap formed between the upper pair of blocking portions 1312 and the lower pair of blocking portions 1312 for the rear end of the shielding shell 4 can resist the blocking portions 1312 to make the glue can not enter between the shielding shell 4 and the insulative housing 5 passing through the blocking portions 1312 when the waterproofing glue plate 8 is molded.

Two rows of terminals 20 are first terminals 21 disposed in the lower row and second terminals 22 disposed in the upper row. Each row of terminals 20 includes a pair of power terminals 201 spaced from each other, two pairs of signal terminals 204 disposed therebetween, two pairs of high frequency differential terminals 202 located at an outside of the power terminals 201 and a pair of grounding terminals 203 disposed at the outside of the high frequency differential terminals 202. Each terminal 20 includes a contacting portion 23 disposed on the corresponding mating surfaces 1021 of the mating tongue 102, a retaining portion 24 retained in the mating tongue 102 and the base portion 101 and a soldering portion 25 extending beyond the base portion 101.

Referring to FIGS. 5 to 9, the pair of discrete metal plates 3 is disposed between the first insulator 11 and the second insulator 12. The metal plate 3 includes a first plate portion 31 disposed in the mating tongue 102, a second plate portion 32 disposed in the base portion 101 and a connecting portion 33 connecting the first plate portion 31 and the second plate portion 32. The outer side of each metal plate 3 defines a locking edge 311 exposed on the two opposite side of the mating tongue 102, specifically, the locking edge 311 extend beyond the retaining slot 1023. The first plate portion 31 and the second plate portion 32 of each metal plate 3 define holes 312, the first plate portion 31 exceeds the high frequency differential terminals 202 in the transverse direction. Each metal plate 3 defines an extending portion 3111 bent from an outer side thereof, the hole 312 of the first plate portion 31 is in front of the extending portion 3111 and the hole 312 of the second plate portion 32 is in behind of the extending portion 3111, the pair of first posts 1121 and the pair of second posts 1221 are engaged with corresponding holes 312 and the first and second retaining grooves 1122,1222, the pair of extending portions 3111 cover on a same matting surface 1021 of the step portion 1022, the second insulator 12 defines a pair of stopping portions 1223 to resist the extending portions 3111 and a slit 1224 between the two stopping portions 1223 to retain the third insulator 13. Each first plate portion 31 defines a locking portion (not labeled) at a front portion of the outside thereof and in front of the extending portion 3111. The top of the extending portion 3111 is parallel with the first plate portion 31 and the second plate portion 32 in the vertical direction. The stopping portions 1223, the horizontal part of the extending portions 3111, and the upper surface of the step portion 1022 are disposed in a same plane. The extending portion 3111 is performed an inverted L-shaped shape, which can increase the retaining force. The extending portion 3111 extends in a front and rear direction and a transverse direction perpendicular to the front and rear direction, each extending portion 3111 extend unitarily from an outer side of the first plate portion 31, the two extending portions 3111 are spaced from each other in the transverse direction. The extending portions 3111 stretch laterally beyond the high frequency differential terminals 202 but not beyond the power terminals 201 in the transverse direction. Because of the pair of metal plates 3 are disposed at two sides of the mating tongue 102, each metal plate 3 defines the extending portion 3111 bent upwardly therefrom and attached to the mating surface 1022 of the step portion 1021, reducing the influence of the electromagnetic interference during transmission of the high frequency signal terminals, what's more, the signal transmission is more stable and the serviceability of the electrical connector 100 is improved. Furthermore, the extending portion 3111 is stretching laterally beyond the high frequency differential terminals 202 but not beyond the power terminals 20, as shielding on the high frequency differential terminals 202 could shield the electromagnetic interference caused by the transmission of the high-frequency signal, therefore, the material of the metal plate 3 can be saved and the predetermined shielding effect can be achieved, and the extending portion 311 is adhered to the surface of the insulative housing 10, which is available to the electrical connection in the trend of miniaturization development of an electrical device (not shown).

Figure 6:
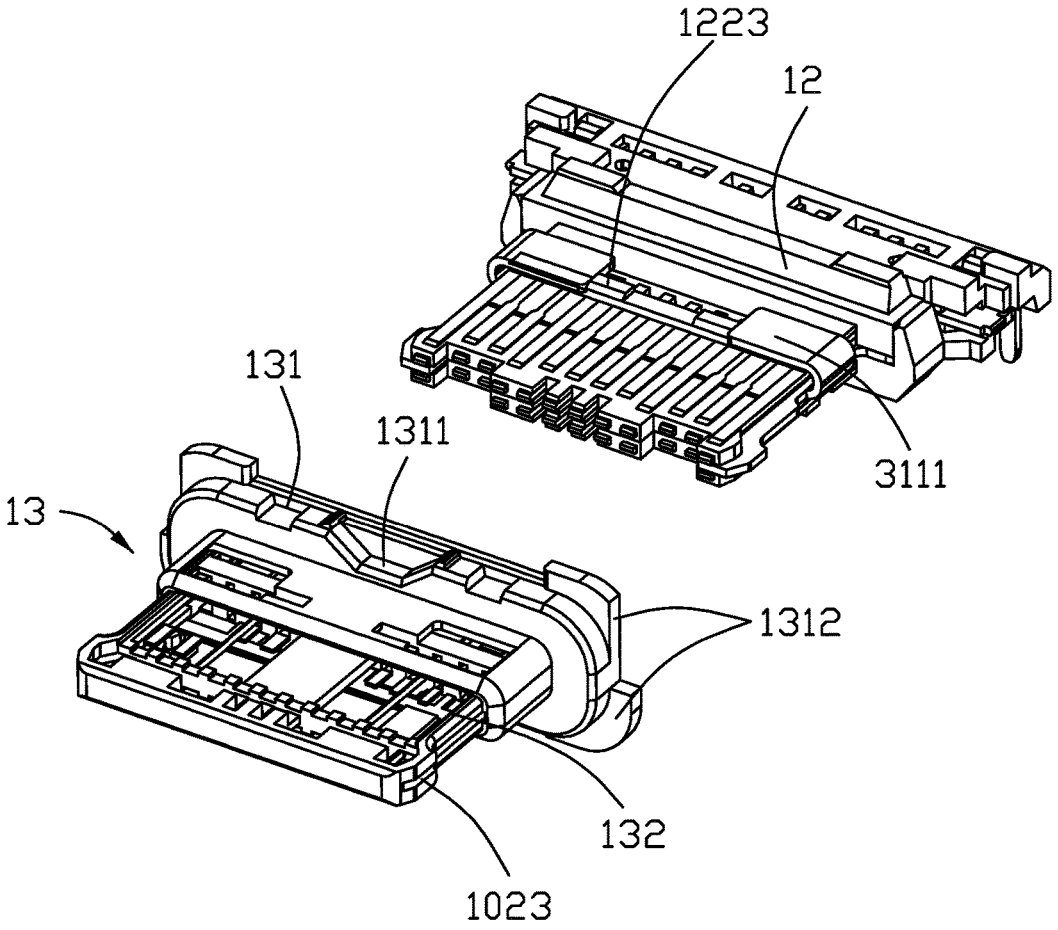
FIG. 6 is a partially exploded perspective view of the terminal module of FIG. 5.
Figure 7:
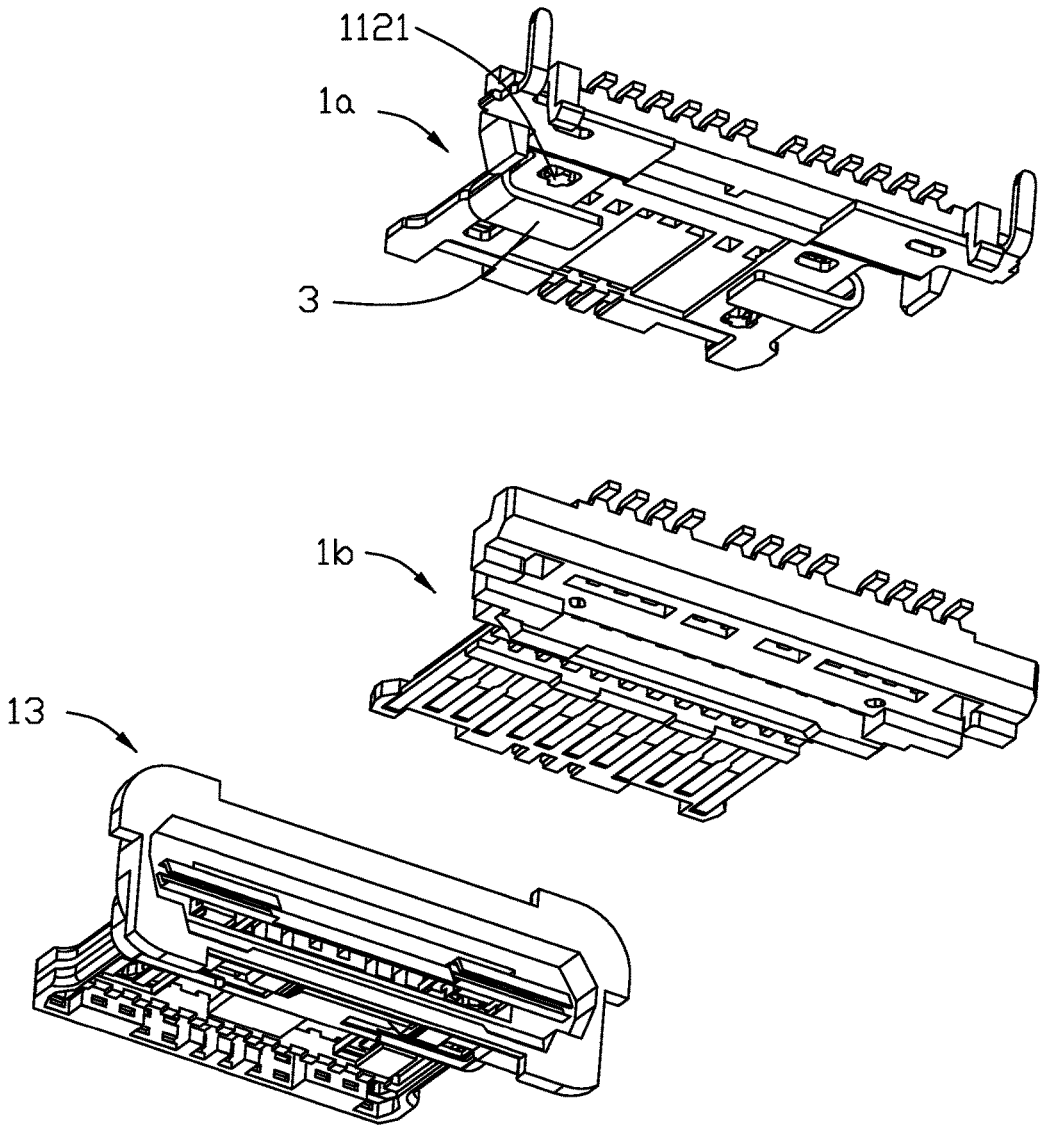
FIG. 7 is a further exploded view of the terminal module of FIG. 6.
Figure 8:
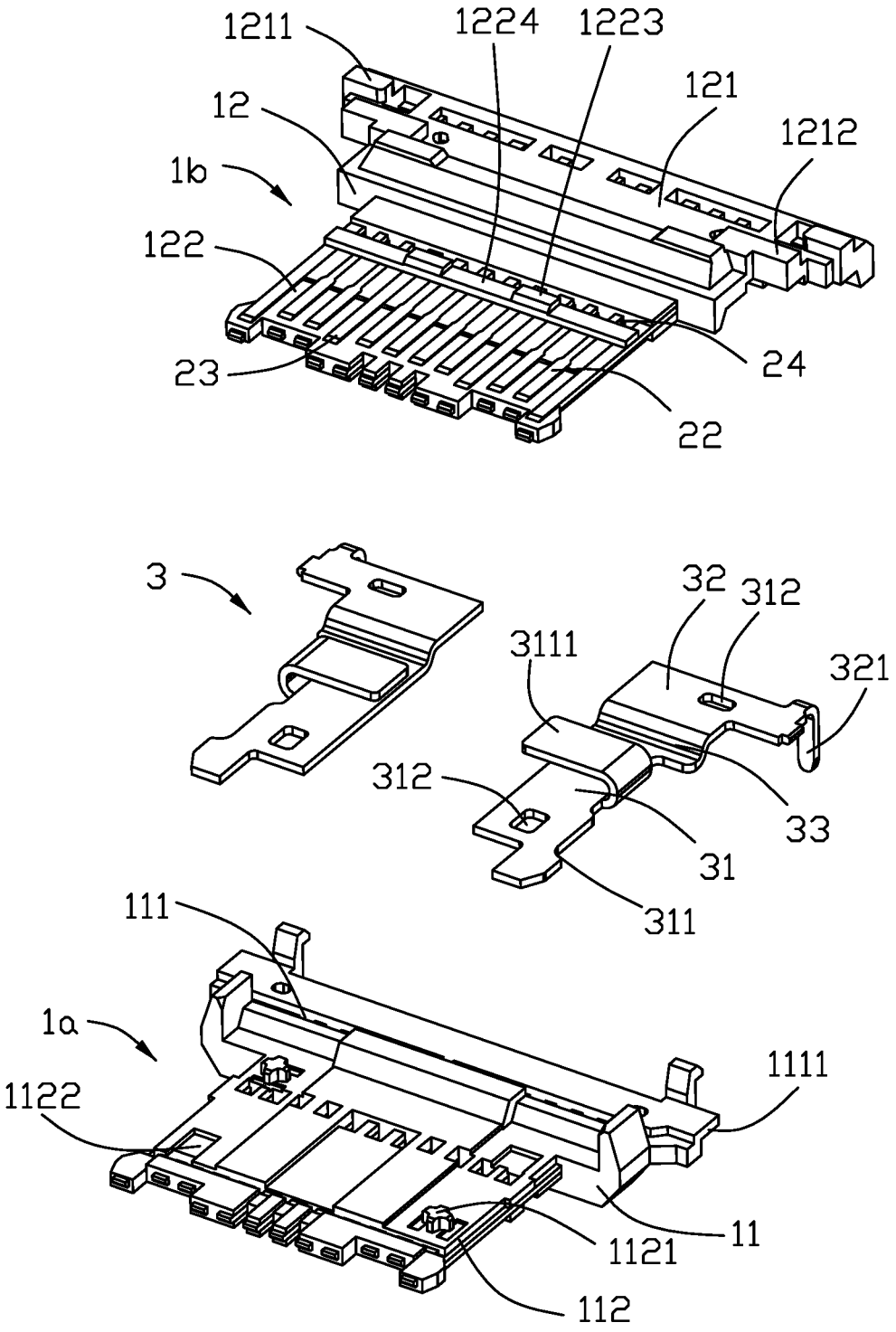
FIG. 8 is a part of the exploded perspective view of the terminal module of FIG. 6.
Figure 9:
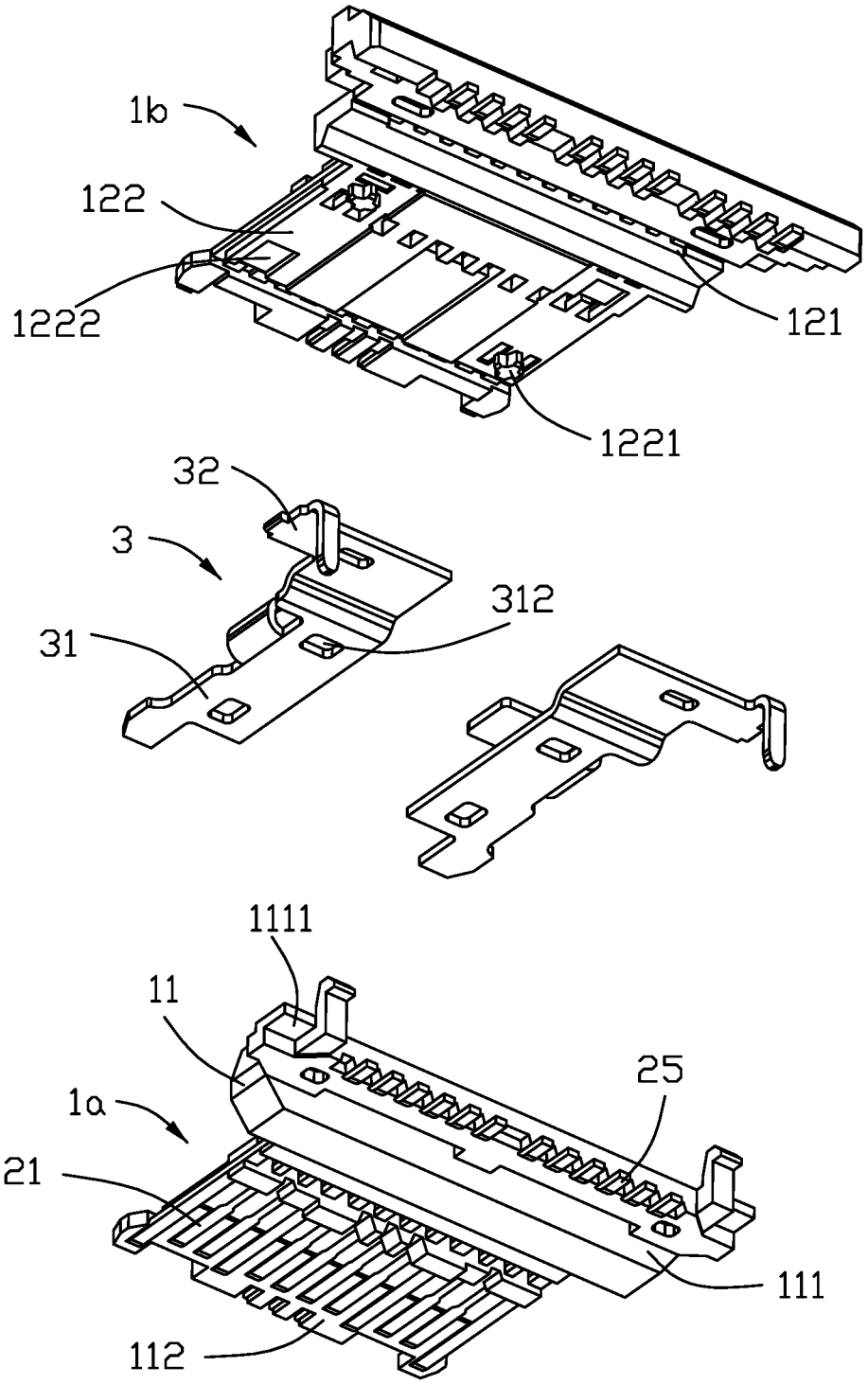
FIG. 9 is an another perspective view of the terminal module of FIG. 8.

Referring to FIGS. 1 to 4, there is no gap between the shielding shell 4 and the insulative shell 5. The shielding shell 4 is made of metal material and performed a cylindrical shape and penetrated along a front-to-rear direction thereof. The shielding shell 4 includes a main body 41 and a pair of side arms 42 extending rearward from two sides of the main body 41. The main body 41 includes an inner surface 411 and a cylindrical outer surface 412, each side arm 42 further includes a grounding tail 421 disposed at the tail thereof and extending downward. The insulative shell 5 includes a first inner wall 51 at the front end, a third inner wall 53 at the rear end, and a second inner wall 52 between the first inner wall 51 and the third inner wall 53. The cylindrical outer surface 412 of the shielding shell 4 is attached to the second inner wall 52 of the insulative shell 5 and the waterproof ring 7 is attached to the outer surface of the first inner wall 51. Referring to FIGS. 5 and 6, the blocking portions 1312 of the third insulator 13 are enclosed and retained in the third inner wall 53, and the waterproof glue plate 8 seals against to the rear end of the base portion 101 and the blocking portion 1312.

The pair of supporting members 6 are separated and disposed symmetrically to each other. Each supporting member 6 includes an embedded portion 61 retained in the insulative shell 5, a mounting arm 62 extending out of the rear end of the insulative shell 5 and an supporting arm 611 bent downwardly. The supporting arms 611 of the supporting members 6 laterally extend out of the two sides of the insulative housing 5 and bent downwardly. Each mounting arm 62 further includes a latching portion 621 and a resisting portion 622, each latching portion 621 is bent upwardly from the upper side of one mounting arm 62 in a transverse direction toward to the other mounting arm 62, each resisting portion 622 is bent upwardly from the downside of one mounting arm 62 in a transverse direction toward to the other mounting arm 62. Each latching portion 621 defines an opening 6211 for engaging with the tab 1211 of the second base 121 to make the latching portion 621 engaged with the tab 1211, each resisting arm 622 is engaged with the mounting portion 1111 of the first base 111.

Referring to FIGS. 1 to 10, a method of making the electrical connector 100 includes the steps of: providing the insulative material, insert-molding the first insulator 11 retaining the first terminals 21 with the insulative material and the first terminals 21, insert-molding the second insulator 12 retaining the second terminals 22 with the insulative material and the second terminals 22. Making the contacting portions 23 of the first terminals 21 and second terminals 22 respectively exposed on the upper surface of the first tongue 112 and the lower surface of the second tongue 122, making the retaining portions 24 of the first terminals 21 respectively partially retained in the first tongue 112 and the first base 111, making the retaining portions 24 of the second terminals 22 respectively partially retained in the second tongue 122 and the second base 121. Making the soldering portions 25 of the first terminals 21 and the second terminals 22 respectively exposed to the rear end of the first base 111 and the second base 121 and performed to two tows along the transverse direction. Having the numbers of the first terminals 21 in accordance with the second terminals 22 and symmetrically arranged to each other.

Providing the first module 1*a* and the pair of metal plates 3, the first module 1*a* including the first insulator 11 and the row of first terminals 21, the first insulator 11 includes the first base 111 and the first tongue 112 extending forwardly from the first base 111, the two sides of the rear end of the first base 111 include two mounting portions 1111, and the first tongue 112 defines the pair of first posts 1121 located on the same plane. The metal plate 3 includes the first plate portion 31 disposed in the mating tongue 102, the second plate portion 32 disposed in the base portion 101 and the connecting portion 33 connecting the first plate portion 31 and the second plate portion 32. Each first plate portion 31 includes the locking edge 311 and two holes 312, extending portion 3111 bent upwardly from the locking edge 311, the extending portion 3111 and the first plate portion 31 forming a mounting space, assembling the first plate portion 31 to the upside of the first insulator 11, the first post 1121 of the first insulator 11 is engaged with corresponding hole 312.

Providing the second module 2*a* including a second insulator 12 and a row of second terminals 22 mounting to the second insulator 12, the second insulator 12 includes the second base 121 and the second tongue 122 extending forwardly from the second base 121. The second base 121 includes two tabs 1211 and two blocking walls 1212. The second tongue 122 defines a pair of second posts 1221 located on the same plane. Assembling the second module 1*b* to the mounting space so as to the first plate portion 31 disposed between the first module 1*a* and second module 1*b*, and the second post 1221 is engaged with the corresponding hole 312.

Providing the insulative material, insert-molding the third insulator 13 within the first module 1*a*, metal plate 3 and second module 1*b* to form an integral terminal module 1. Part of the third tongue 132 of the third insulator 13 is enclosing the first base 111 and the second base 121. At the same time, the pair of extending portions 3111 is disposed in the same plane and spacing a distance and disposed at the behind of the locking edge 311 and attached to the mating surface 1022 of the step portion 1021. The extending portion 3111 is stretching laterally beyond the high frequency differential terminals 202 while not beyond the power terminals 201, therefore, the material of the metal plate 3 can be saved while achieving the predetermined shielding effect.

Providing the insulative material, the shielding shell 4 and the pair of supporting members 6. The shielding shell 4 and the pair of supporting members 6 are made of metal material. Firstly, insert-molding the insulative shell 4 retaining the pair of supporting members 6 with the insulative material and the supporting members 6, the shielding shell 4 and insulative shell 5 are insert-molded without gap therebetween. Attaching the cylindrical outer surface 412 of the shielding shell 4 to the second inner wall 52 of the insulative shell 5, resisting the front end of the main body 41 to the intersection between the first inner wall 51 and second inner wall 52, forwardly resisting the four blocking portions 1312 of the third base 131 on the intersection between the inner wall 52 and the third inner wall 53, and resisting the rear end of the shielding shell 4 to the blocking portion 1312. The first inner wall 51 is flush with the inner surface 411 of the main body 41. Forming a mating space 50 between the first inner wall 51 and the mating tongue 102 makes the mating connector and the electrical connector 100 have a stability electrical connection. The mounting arms 62 of the pair of the supporting members 6 are surrounding the pair of the side arms 42, each mounting arm 62 is respectively retained to the side arm 42 by laser welding.

Providing the liquid silicone, insert-molding the waterproof ring 7 disposed in the front of the insulative shell 5 and a retaining recess 54 surrounding the insulative shell 5 with the liquid silicone and insulative shell 5 retaining the pair of the supporting members 6 and shielding shell 4, and insert-molding the waterproof glue plate 8 with the liquid silicone injected to the gap of the third inner wall 53 and base portion 101 and the tail of the insulative housing 5.

Figure 10:
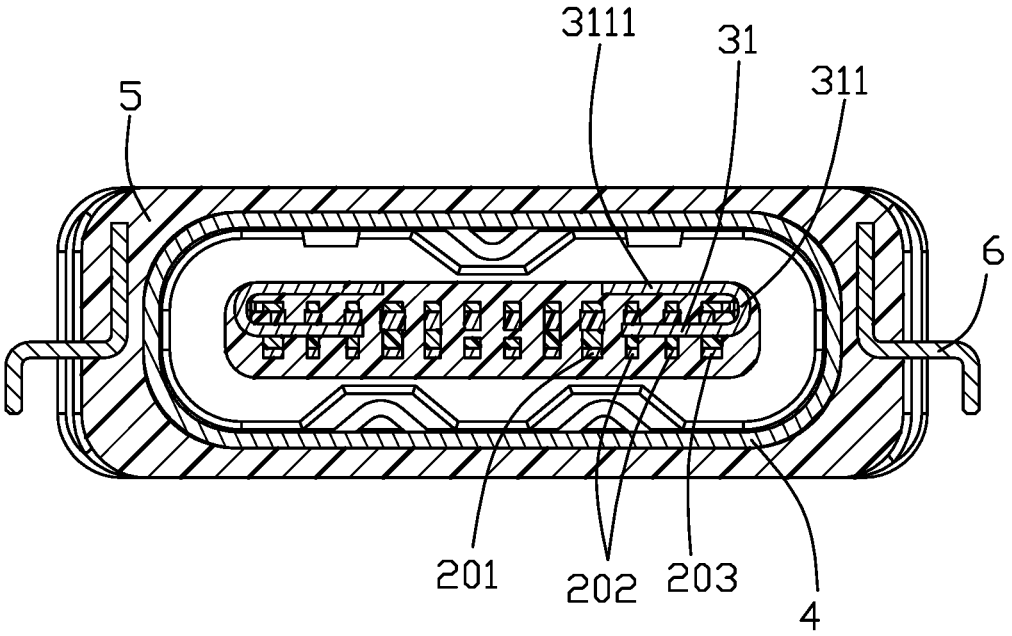
FIG. 10 is a cross-sectional view of the electrical connector along line 10-10 in FIG. 1.

However, the disclosure is illustrative only; changes may be made in detail, especially in matter of shape, size, and arrangement of sections within the principles of the invention. In the invention, of the housing the first insulator and the second insulator are either spaced, in the vertical direction, from each other via the metal plate or the third insulator, or abut against each other in the vertical direction as shown in FIG. 10.

What is claimed is:

1. An electrical connector comprising:

an insulative housing having a base portion and a mating tongue extending forwardly from the base portion, the mating tongue defining two opposite mating faces and a step portion at a root thereof to the base portion;

two rows of terminals retained in the insulative housing and including contacting portions disposed on the mating surface and in front of the step portion;

a pair of discrete metal plates located between the two rows of terminals, each metal plate comprising a first plate portion disposed in the mating tongue, a second plate portion disposed in the base portion, each first plate portion defining a locking edge at an outer side thereof and exposed to a corresponding side face of the mating tongue; wherein each metal plate further comprises an extending portion bent from an outer side thereof, the extending portion covers the matting surface of the step portion; wherein the extending portion extends in a front and rear direction and a transverse direction perpendicular to the front and rear direction, and the two extending portions are spaced from each other in the transverse direction.

2. The electrical connector as claimed in claim 1, wherein the two extending portions of the pair of the metal plates cover on a same mating surface of the step portion.

3. The electrical connector as claimed in claim 2, wherein the insulative housing defines a pair of stopping portions to resist the extending portions.

4. The electrical connector as claimed in claim 1, wherein the two rows of terminals include first terminals on a upper row and second terminals on a lower row, each row of terminals includes a pair of power terminals spaced from each other and two pairs of high frequency differential terminals located at an outside of the power terminals, the extending portion stretches laterally beyond the high frequency differential terminals but not beyond the power terminals in the transverse direction.

5. The electrical connector as claimed in claim 4, wherein the metal plate further includes a connecting portion connecting the first plate portion and second plate portion, the locking edge and the extending portion are formed at the first plate portion.

6. The electrical connector as claimed in claim 5, wherein the first plate portion exceeds the high frequency differential terminals in the transverse direction.

7. The electrical connector as claimed in claim 5, wherein the insulative housing includes first insulator, second insulator and third insulator made through three insert-molded processes, the first terminals are insert molded in the first insulator, the second terminals are insert-molded in the second insulator, the third insulator is insert-molded at an outside of the first insulator and the second insulator to form the insulative housing.

8. The electrical connector as claimed in claim 7, further comprising a shielding shell and an insulative shell integrally formed with the shielding shell, the shielding shell performed a cylindrical shape and penetrated along a front-to-rear direction.

9. The electrical connector as claimed in claim 5, wherein the top surface of the extending portion is parallel with the first plate portion and the second plate portion.

10. The electrical connector as claimed in claim 5, wherein the extending portion is performed an inverted L-shaped shape.

11. An electrical connector comprising:

an insulative housing having a base portion and a mating tongue extending forwardly from the base portion, the mating tongue defining two opposite mating faces and a step portion at a root thereof to the base portion;

two rows of terminals retained in the insulative housing and including contacting portions disposed on the mating surface and in front of the step portion;

a pair of discrete metal plates located between the two rows of terminals; each metal plate comprises a first plate portion embedded in the mating tongue and disposed between the two rows of terminals; and a pair of extending portions covering the mating face of the step portion;

wherein the first plate portions and the extending portions extend in a front and rear direction and a transverse direction perpendicular to the front and rear direction in a top view of the electrical connector, the first plate portions and the extending portions stretch inward beyond high frequency differential terminals of the two rows of the terminals while not reaching power terminals of the two rows of the terminals.

12. The electrical connector as claimed in claim 11, wherein each extending portion extends unitarily from an outer side of the first plate portion.

13. The electrical connector as claimed in claim 11, wherein each first plate portion defines a locking portion at a front portion of the outside thereof and in front of the extending portion.

14. An electrical connector comprising:

a terminal module including:

an insulative housing having a base portion and a mating tongue extending forwardly from the base portion in a front-to-back direction, the mating tongue defining two opposite mating faces and a step portion at a root thereof adjacent to the base portion;

two rows of terminals retained in the insulative housing and including contacting portions disposed on the mating surface and in front of the step portion;

a pair of discrete metal plates located between the two rows of terminals in a vertical direction perpendicular to said front-to-back direction, and spaced from each other in a transverse direction perpendicular to both the front-to-back direction and the vertical direction, each of said metal plates comprising a first plate portion disposed in the mating tongue, a second plate portion located behind the first plate portion and disposed in the base portion, each first plate portion defining a locking edge at an outer side thereof and exposed to a corresponding side face of the mating tongue; wherein each metal plate further comprises an extending portion spaced from the first plate portion in said vertical direction to cover the mating surface of the step portion; wherein said terminals includes power terminals, and both the first plate portion and the extending portion have corresponding inner edges not to extend beyond corresponding power terminals in the transverse direction.

15. The electrical connector as claimed in claim 14, wherein each row has twelve terminals, and each of said metal plate spans in the transverse direction corresponding to three outermost terminals.

16. The electrical connector as claimed in claim 15, wherein said three outermost terminals include a pair of high speed differential pair and one ground.

17. The electrical connector as claimed in claim 14, wherein in each metal plate, the extending portion extends from an outer side of the corresponding first plate portion.

18. The electrical connector as claimed in claim 14, wherein the housing includes a first insulator, a second insulator and a third insulator, the first insulator is integrally formed with one row of terminals, the second insulator is integrally formed with the other row of terminals, and the third insulator is applied upon both the first insulator and the second insulator.

19. The electrical connector as claimed in claim 18, wherein in the housing, the first insulator and the second insulator are either spaced from each other in the vertical direction via the third insulator or the first plate portion, or abut against each other in the vertical direction.

* * * * *